US005694723A

United States Patent [19]

Parker

[11] Patent Number: 5,694,723

[45] Date of Patent: Dec. 9, 1997

[54] APPARATUS AND METHOD FOR WATER DRAINAGE AND RADON REMOVAL

[76] Inventor: Alton F. Parker, 8 Hiawatha Dr., Clifton Park, N.Y. 12065

[21] Appl. No.: 565,061

[22] Filed: Nov. 30, 1995

Related U.S. Application Data

[63] Continuation-in-part of Ser. No. 437,981, May 10, 1995.

[51] Int. Cl.[6] ..... E02D 31/02; E04B 1/70

[52] U.S. Cl. ..... 52/169.5; 52/169.14; 52/302.3; 52/742.1; 405/45; 405/50; 404/4; 404/8

[58] Field of Search ..... 52/169.5, 169.8, 52/169.14, 302.3, 302.1, 287.1, 741.3, 741.4, 742.1; 405/45, 50; 604/2, 4, 8

[56] References Cited

U.S. PATENT DOCUMENTS

| | | | |
|---|---|---|---|
| 3,283,460 | 11/1966 | Patrick . | |
| 3,850,193 | 11/1974 | Guzzo | 52/169.5 X |
| 3,852,925 | 12/1974 | Gazzo | 52/169.5 |
| 3,979,860 | 9/1976 | Roth et al. | 52/302.1 X |
| 4,075,800 | 2/1978 | Molick | 52/302.3 |
| 4,245,443 | 1/1981 | Beechen . | |
| 4,333,281 | 6/1982 | Scarfone | 52/169.5 |
| 4,745,716 | 5/1988 | Kuypers . | |
| 4,757,651 | 7/1988 | Crites . | |
| 4,798,034 | 1/1989 | Jarnagin et al. | 52/169.5 |
| 4,869,032 | 9/1989 | Geske . | |
| 4,879,851 | 11/1989 | Boccia | 52/169.5 |
| 4,907,385 | 3/1990 | Biotrowski | 52/169.5 |
| 4,907,386 | 3/1990 | Ekroth | 52/169.14 |
| 5,044,821 | 9/1991 | Johnson | 52/169.5 X |
| 5,054,252 | 10/1991 | Newman | 52/169.14 |
| 5,289,664 | 3/1994 | Rizza et al. | 52/302.1 |
| 5,466,092 | 11/1995 | Semenza et al. | 52/169.5 X |
| 5,501,044 | 3/1996 | Janesky | 52/169.5 |

FOREIGN PATENT DOCUMENTS

| | | | |
|---|---|---|---|
| 2520441 | 11/1976 | Germany | 52/302.3 |
| 3505458 | 8/1986 | Germany | 52/302.3 |
| 0613402 | 12/1960 | Italy | 52/169.5 |

*Primary Examiner*—Carl D. Friedman
*Assistant Examiner*—Winnie Yip
*Attorney, Agent, or Firm*—Schmeiser, Olsen & Watts

[57] ABSTRACT

A concrete slab and wall spacer with water and radon removal elements. The invention includes a cross-sectionally, L-shaped elongate strip of semi-rigid, nonbio-degradable material. At least halfway up the entire elongate vertical leg of the L-shape may be a horizontally disposed projection which is integral with the strip. The spacer projection is placed against a wall, the L base resting on a portion of the footing subtended by the wall in a conventional spacer usage. An spacer may be provided for additional support of the L-shaped strip. This spacer is easily removable after the floating slab has set, or the spacer may be left in place for use as a decorative molding. Several applications for the strip, are disclosed, one being the sealing of the shelf to the abutting wall with placement of a gas impermeable membrane in an overlapping arrangement with the L base so as to form, relative to the strip and the abutted wall, an upper fluid region and a lower gas region. The gas region is vented by a conduit which penetrates the projection, while the water in the upper liquid region is removed by other conventional methods, conceivably by through-the-wall conduits or a sump region built into or adjacent the footing.

19 Claims, 4 Drawing Sheets

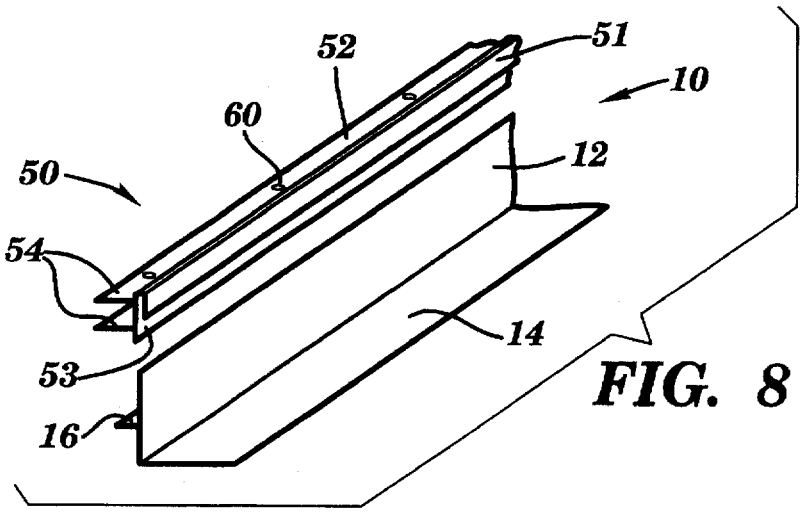
FIG. 8
FIG. 9
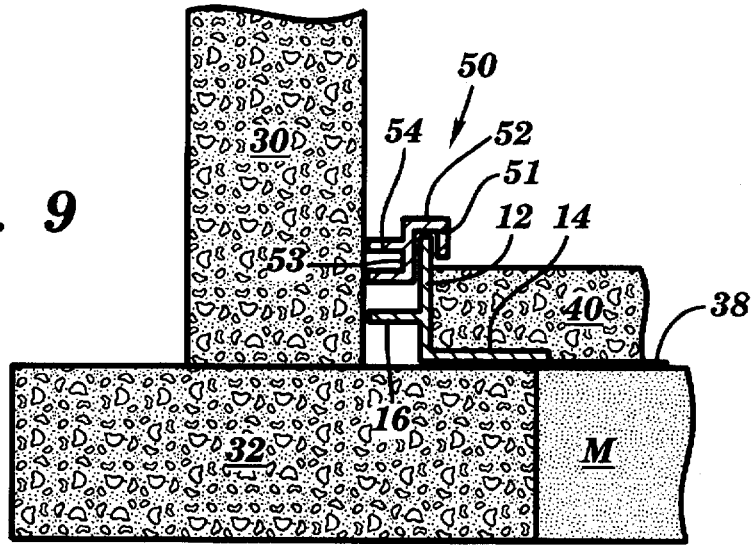
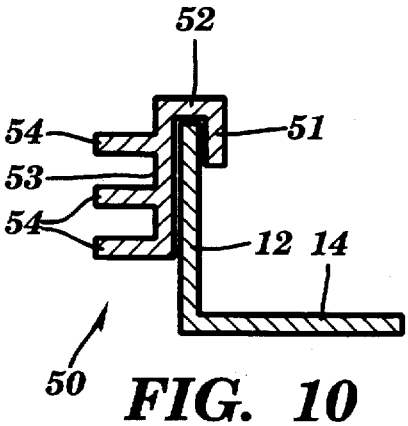
FIG. 10
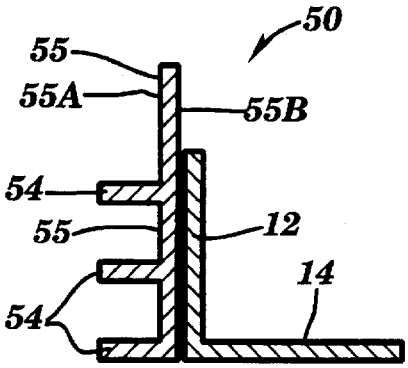
FIG. 11

APPARATUS AND METHOD FOR WATER DRAINAGE AND RADON REMOVAL

This application is a continuation-in-part of pending application Ser. No. 08/437,981, filed May 10, 1995.

BACKGROUND OF THE INVENTION

1. Field of the Invention

This invention relates generally to an apparatus for water drainage and radon removal adapted to be positioned at a joint formed by a footing, a wall and a floor slab. More particularly, this invention relates to a combination water removal and radon venting apparatus that includes a removable spacer for supporting the apparatus during the placement of a floor slab and providing a clean channel after the placement.

2. Relevant Art

Concrete slabs, mostly in basements and subterranean structures, are generally constructed to be set apart from surrounding walls. They rest on well-drained soil/gravel matrices and are colloquially termed to "float." Many devices have been created in order to construct the walls and, subsequently, the slabs so that the latter features this floating character, the character having been acquired through use of a concrete form, either temporary or permanently installed, that allows a separation to exist between the peripheral walls and the curing slab. Stand-offs or separators that impart this characteristic to a wall-slab complex have existed for years and, in the past two decades, have been augmented with features or options that enhance the drainage of water which may accumulate on the slab or seep from the walls to the wall-slab interface. Generally, these wall-slab separators have two modes of use. The first is the permanent wall-slab separator that is permanently installed and therefore requires some sort of corrugation so that the water may flow from the walls, through the corrugations, and then under the slab to a drain tile installed in the matrix. The second mode of operation utilizes a piece of lumber or the like having the appropriate width. The piece of lumber is placed against the wall and the concrete is poured. When the concrete is dry, the piece of lumber is removed from the channel.

Patents relevant to this slab spacer and water drainage conception are: U.S. Pat. Nos. 4,869,032 ('032); 4,757,651 ('651); 3,283,460 ('460); 4,745,716 ('716); and, 4,245,443 ('443).

An apparatus and method for waterproofing basements is disclosed in '032, which teaches a device of elongate form having a vertical leg joined to an orthogonal horizontal leg. In cross-section, the device resembles a stylized L-shape with the top margins of the vertical leg reflexing away from the horizontal leg. The vertical leg is periodically vented, while the horizontal leg, as well as portions of the vertical leg, have a series of integral conduits or elongate detents which may be characterized as corrugations.

It is the purpose of the device, additional to acting as a spacer or stand-off form to acquire separation between a concrete slab and the adjacent wall, to provide a path from the wall face and wall-footing juncture over the footing to an adjacent gravel bed which is drained by a porous or foraminous drainage conduit. This facility (of water drainage) combined with a slab-wall separator form is characteristic of all of the art, including the instant invention, to be hereinafter discussed.

Patent '651 discloses a wall system for use on a vertical wall, such as a basement wall. A drain conduit is positioned adjacent the wall footing and a collection member is mounted along the bottom of the wall. The collection member is a stand off of rigid construction which has reflexed top and bottom margins to acquire the stand-off facility and collect water from the wall-footing juncture. The collection member is further manifolded, by a plurality of drainage lines, to a large drain conduit that is subtended by the slab and wall-footing juncture and receives the drainage waters from the collection member.

An L-shaped means for damp proofing basements is disclosed in Patent '460 and features an essentially solid device having, on the outside surfaces of the L, a plurality of vertical grooves communicating with a plurality of horizontal grooves. Thus, additional to its stand-off feature, which affords a spacing between the wall and the concrete slab, the disclosed device is conducive to the channeling of water seepage from the wall and footing towards the adjacent, and otherwise conventional, footing drain. The structural wall control device of Patent '716, though of clearly different design than '460, nevertheless embodies the same precepts and functions in the same manner. Details or options are added such as an alignment strip which allows a user to level the floor by using a string and chalk, or other conventional means, to mark the desired level on the alignment strip so that the concrete can be poured to the desired level and not overflow into the vertical corrugations which are to act as drains.

The last in the series of relevant art patents, Patent '443, teaches a seepage control device that has the usual L-shape cross-section in which the vertical member or component includes a series of corrugations; the horizontal component features a similar plurality of corrugations or channels. In this embodiment, the inner portions of the L-shape are smooth and flat, that is, the relief of the corrugations is on the outside of the vertical and horizontal surfaces only. This allows the shape of the slab to effect straight, smooth margins. Further, the '443 device, like the '615 device, employs a plurality or series of nails, studs or bolts to affix the inner face of the vertical member directly to the wall. All of the other relevant art patents appear to have no means for fastening the device to the wall or the footing.

Modern construction has gone beyond the decades-old requirements for slab separation and water drainage. Today, modern construction has seen the demand for sub-slab radon removal, as well as the fulfillment of the older requirements. Current radon removal techniques generally embody the placement, below the slab, of a radon scavenging network. It generally includes a radon venting network beneath the slab and adjacent the footings and is vented, proximate the wall surfaces, to atmosphere. To ensure that radon does not penetrate cracks in the slab, a gas-impermeable barrier is generally set between the slab subsurface and the slab. Thus, in addition to being drained by whatever water venting means is used, the radon scavenging network performs its function additional to, and isolated from, the slab separation and water removal functions. This bifurcation, and often trifurcation, of functions and facilities is expensive in terms of supplies and extremely time consuming in their piecemeal installation. With the increasing cost of materials and supplies, as well as those of labor, it is clearly evident that a demand exists for a more reasonable and economical solution.

3. Incorporation by Reference

Being relevant to this disclosure, the following patents are hereinafter incorporated by reference: U.S. Pat. Nos. 4,869,032, 4,757,651, 3,283,460, 4,745,716, and 4,245,443.

SUMMARY OF THE INVENTION

The instant invention answers the aforementioned need for acquiring a drainage form with water and radon removal features. Essentially a water seepage control device for draining the floor slab and the slab perimeter walls, it includes an L-shaped strip of semi-rigid, nonbiodegradable material that has a vertical portion running coterminously with an orthogonally disposed horizontal portion. In the preferred embodiment, surfaces characterizing the internal angle of the L-shaped device are flat or planar and without relief. At least halfway up the outside of the vertical portion is an integral ledge or shelf projection that provides the actual stand-off character of the L-shaped form. In a preferred embodiment, the bottom or outside surface of the horizontal (base) portion may be relieved by grooves, corrugations, hobnail effect or any other form of (networking) relief that would allow water to seep under the form, as well as radon gas to transpire in the opposite direction. Maintaining this communication aspect is a plurality or series of grooves, cuts or notches running vertically and periodically through the shelf/ledge member. Additionally, several options, in the way of accessories or features, are available for usage with the preferred embodiment and serve as enhancements to the installation of the preferred embodiment when it is to specifically incorporate water removal and/or radon venting features.

One such option employs the preferred embodiment without a notched or grooved stand-off shelf. The form is placed against a wall-footing juncture with the interior angle pointing outward and the shelf/ledge against the wall. Venting holes are provided at strategic positions along the wall and a conduit is snugly fitted into each of the vents. The shelf-wall juncture is sealed with a caulk that, like the invention, is water impervious, nonbiodegradable and has adhesive qualities allowing it to act as a sealant between the wall and the shelf. Thus, the shelf forms a line of demarcation between an upper portion of the invention called a liquid region and a lower portion between the wall and the invention, termed a gaseous region. With the placement of a radon gas barrier over/under the horizontal portion or base of the invention such that it effectively is conterminous with the (wall) peripherally installed invention, the sub-slab, sub gas barrier region is vented of radon. Radon moves from under the barrier, under the relieved surface of the invention's horizontal (base) portion into the gaseous region that is demarcated by the shelf and sealant bead, and therefrom vented through one of the vertically installed conduits by means (such as exhaust pump) that are known in the building trades.

Another option or enhancement includes the use of an spacer which may snap or rest on the vertical portion of the L-shaped strip. In a first embodiment, the spacer comprises a flange extending from an inner arm of the spacer to better support the L-shaped strip during the placement of the concrete. Also, the flange serves as a shelf onto which the debris from the placement process will fall. This shelf is then removed so a clean channel is formed. Another possible spacer is simply a parallelepiped that fits into the channel and extends above the level of the top of the vertical portion of the L-shaped strip. The parallelepiped or other spacer may comprise at least one pre-punched aperture or hole for the insertion of some grasping means, such as a crow bar or the like or it may comprise a pre-formed arm projecting outwardly from the spacer for grasping. These alternatives allow the laborer to more readily remove the parallelepiped from the channel once the concrete has been placed.

Additional options or enhancements that are acquired with the preferred embodiment consist, in one instance, the aforementioned relieved bottom of a horizontal portion of the invention. Yet another optional feature includes a flexible ribbonous flap-like addition that is secured to the base member conterminous the interior angle of the L-shaped form. This flap is liftable, to form a pocket, and allows insertion of the radon gas barrier membrane between it and the base upper surface. For economy's sake, this flap option may be dispensed with and ordinary adhesive, such as roofing cement of any number of the adhesives used in modern construction, may be smeared on the installed invention over the upper surface of the base in order to adhere the margins of the radon gas barrier thereto. Alternatively, the barrier may be placed between the base and the footing and the invention nailed to the footing.

The size of the drainage form is not of particular concern save that the height of the vertical portion must be sufficient to ensure that the slab concrete, when poured, will not spill over onto the stand-off ledge of the invention, especially if it is installed in the preferred embodiment having vertical grooves or notches through the ledge, as aforementioned. Although, if the present invention is used in combination with the removable spacer, the grooves are protected from debris regardless of the height and therefore this consideration is not necessary.

The base may be of a length suitable for stabilizing the invention on a footing or, in cases where permanently installed form-drain members are used, the base may be extended to a portion of that form-drain member and secured to the upper surface thereof. In cases where the invention projects above the slab surface, and it is desirable to maintain some slab surface drainage, portal areas may be readily cut out of the vertical portion of the drainage form flush with the existing slab. Provision of knockout points along the upper margin of the slab would appear useful; however, such would constitute an uneconomical adjunct. A small reciprocating saw, or similar device, could be used to readily create a number of such ports if they were required. In cases where the zonal separation of liquid and gaseous substances are defined, it makes no difference that the slab is raised to the uppermost margin of the invention, since no vertical grooves or notches are present in the shelf of the invention. Since the drainage form is to be a semi-rigid, nonbiodegradable element, a great number of materials may be used to realize the physical embodiment. The most economical to produce are extruded or formed plastics such as polyvinyl chloride (PVC) or high-density polyethylene. Other materials such as asphalt impregnated fibrous boards or fiber glass will also suffice. Material selection, the same as options aforementioned, may be selected at the discretion of the manufacturer or the user of the invention.

BRIEF DESCRIPTION OF THE DRAWINGS

Of the drawings:

FIG. 8 is an exploded perspective view of the present invention in combination with a first embodiment of the spacer;

FIG. 9 is a cross-sectional view of the present invention as shown in FIG. 8;

FIG. 10 is a cross-sectional view of the L-shaped strip in combination with an alternative first embodiment of the spacer;

FIG. 11 is a cross-sectional view of the L-shaped strip in combination with a second embodiment of the spacer;

DETAILED DESCRIPTION OF THE PREFERRED EMBODIMENT

Figure 2:
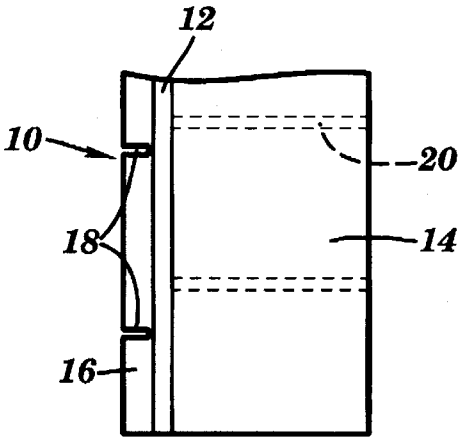
FIG. 2 is a top plan of the invention.
Figure 1:
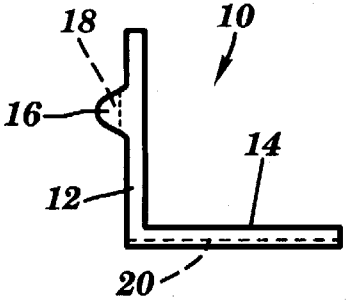
FIG. 1 is a side elevation of the invention.

Referring to FIG. 1, a side elevation of the drainage form 10 discloses the L-shape form with the vertical portion or second surface 12 being orthogonally disposed with respect to, and coterminous with, the horizontal portion or first surface 14. The second surface 12 is angularly offset from the first surface 14 and is shown in the various Figures at a 90° angle, however, it should be understood that any angle under 180° may be used with varying degrees of efficiency. Projecting from the backside of the vertical portion 12 is a detent, ledge or shelf 16 disclosing the (invisible) vertical slots 18 that are periodically located in the shelf. Other features, comprising options to the preferred embodiment, are the additional thickness which includes grooves 20 or corrugations in the horizontal portion 14 (hereinafter termed base). FIG. 2 is a top plan of the FIG. 1 embodiment and discloses the features previously discussed.

Figure 3:
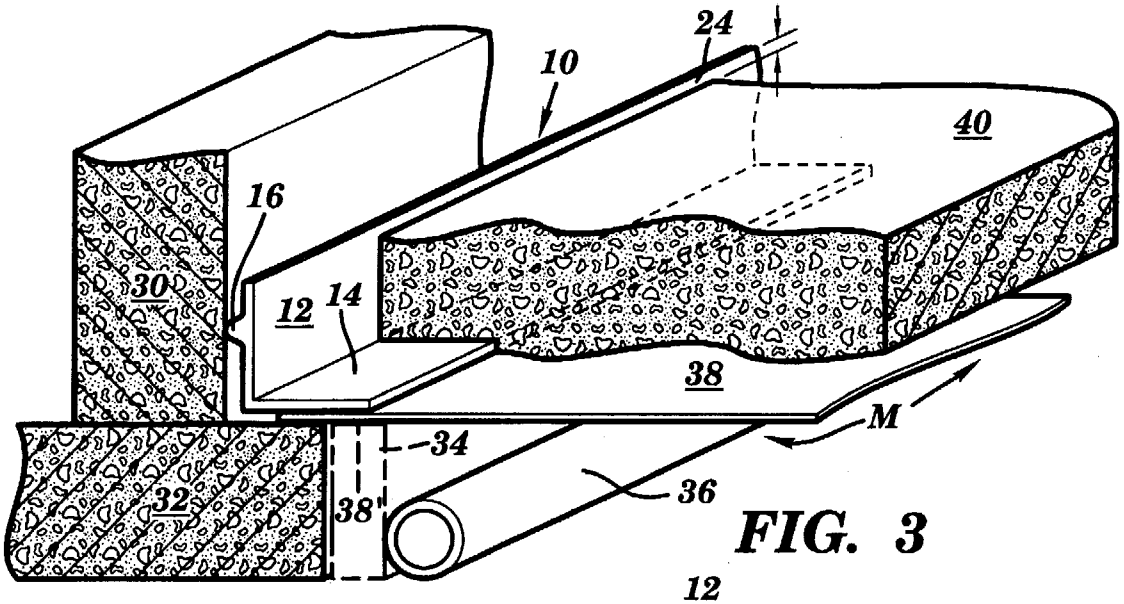
FIG. 3 is an illustration of the invention installed in conventional wall-slab separation posture.

FIG. 3 shows the drainage form 10 in an installed mode conforming to a wall 30 on footing 32 construct. The shelf 16 is shown in abutment with the wall 30 while the base of the drainage form 10 rests on the footing 32 with a notable overhang onto permanently installed footing form 34. Thus, the FIG. 1 embodiment may be nailed base-to-footing or base-to-form 34, as the installer desires. Whether alongside the footing 32 or a permanently installed form 34, drain tile 36 is the conduit for removing any water passing down the wall 30, over the footing 32 and under the drainage form 10 into the soil and gravel matrix M, which serves as the foundation for the slab 40. Alternatively, the water may be channelled to a sump pump (not shown). Interposed the slab 40 and the matrix M is an impermeable radon gas barrier 38. The barrier 38 is generally a membrane or film made of commonly available polyethylene plastic or any other material impermeable to radon gas and is installed over the matrix M and onto the footing 32. When using the drainage form, however, the barrier 38 overlaps a portion (above, or below 38') or all of base 14. Lastly, in FIG. 3 there is disclosed the extension 24 of the vertical portion 12 of the drainage form. As shown by the opposing arrows (immediately below 24), the extension may be cut off in certain areas after the slab 40 cures. However, in the figure description that follows, a special liquid-gas separation option obviates the need to maintain the slab top surface below the upper margin of the vertical portion 12. The extension 24 is, nonetheless, shown in that figure (FIG. 4) for illustration purposes only.

Figure 4:
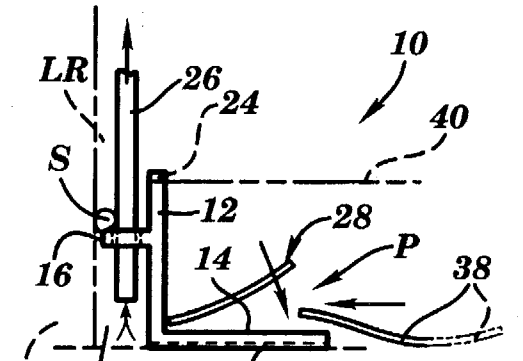
FIG. 4 is a side elevation of the invention with selected options.
Figure 5:
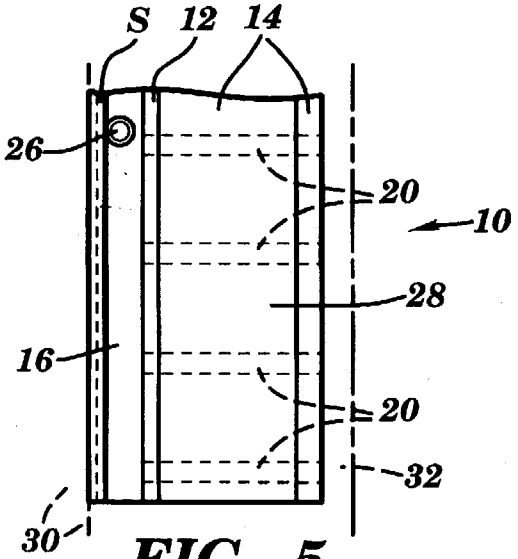
FIG. 5 is a top plan of the FIG. 4 embodiment.

Referring now to FIG. 4, the preferred embodiment of the drainage form 10 is shown with elements bearing the same nomenclature as in FIGS. 1 and 2. Additionally, the shelf 16, seen almost abutting the wall 30, is adhesively sealed therewith by an adhesive, water impermeable and nonbiodegradable sealant S. This construction demarcates the area between the wall 30 and the invention 10 into an upper liquid region LR and a lower, gas region GR, the latter being ventable through conduit 26 of which more than one may exist in any completed installation. Another unique feature to this figure is the use of flap 28 which is sealed at a margin coterminous with the interior angle of the L-shape, that is the coterminous juncture of the vertical portion 12 and the base 14 of the invention. This flexible flap 28 forms a pocket P into which the barrier 38 may be inserted as shown. A reference to FIG. 5 discloses a top plan of the FIG. 4 embodiment except for the slab 40 and pocket P definition.

Figure 7:
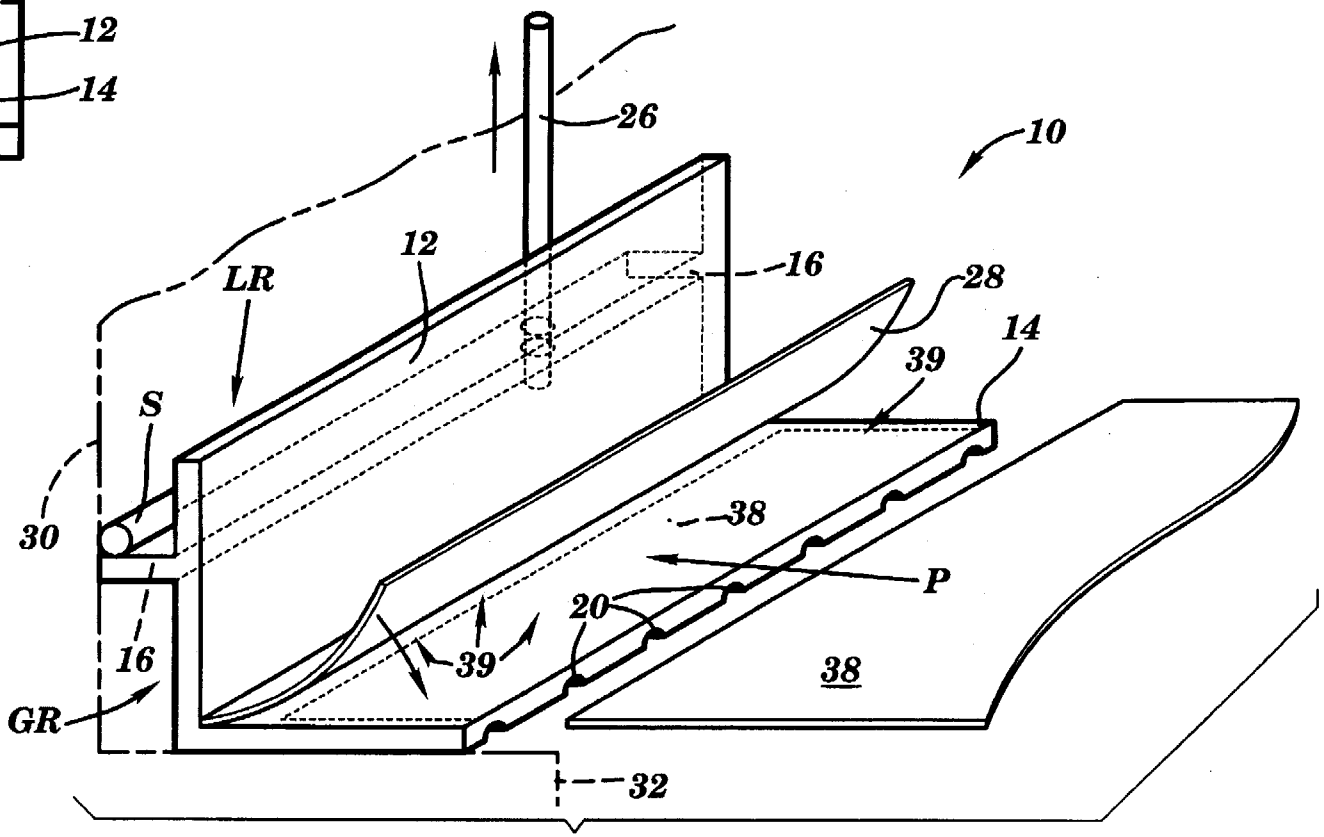
FIG. 7 is an isometric illustration of the FIGS. 4 and 5 embodiment of the invention.
Figure 6:
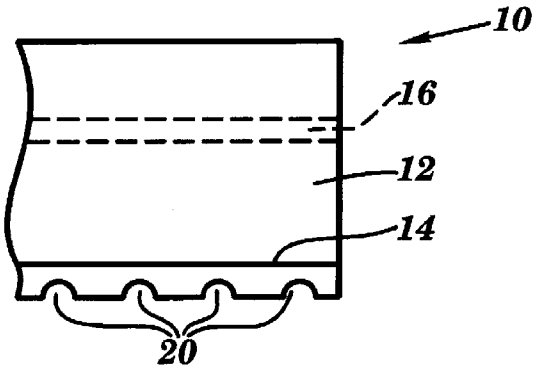
FIG. 6 is a frontal elevation of the invention.

Referring to both FIGS. 6 and 7, the former being a frontal elevation of the invention and the latter an isometric illustration of the FIG. 4 embodiment, a clearer picture is afforded. Although FIG. 1 discloses a preferred embodiment, such refers only to the drainage form itself. From the point of view earlier expressed, that is, an economical device affording all of the modern, desired attributes of water and radon removal, the FIG. 7 embodiment, absent perhaps the flap 28, affords all of these features. As mentioned earlier and as regarding FIG. 7, the flap 28 may be dispensed with and in lieu thereof ordinary mastic or adhesive, as is common throughout the industry, may be used to adhere barrier 38 to the upper surface of the base 14 approximately in the area denoted by the dash lines 39.

FIG. 9 shows the drainage form 10 being used in combination with a first embodiment of an optional, removable spacer 50. The first embodiment of the spacer 50 comprises an outer arm 51, a base 52, and an inner arm 53 longer than the outer arm 51. The inner arm 53 further comprises at least one flange, finger, or extension 54. This flange 54 serves the first purpose of providing additional support to the vertical portion 12 of the drainage form 10, so that the height of the shelf 16 along the vertical portion 12 is not critical. Secondly, the spacer 50 serves as an additional shelf that will catch debris, such as cement that is smoothed over the top of the vertical portion 12 of the drainage form 10, which, if left after the placement of the concrete, would not be aesthetically pleasing and could potentially cover the conduits 26 running through the shelf 16.

As shown in FIG. 8, this embodiment of the spacer 50 fits easily over the top of the vertical portion 12. The spacer 50 may additionally comprise one or more holes or apertures 60, as also shown in FIG. 8. A crowbar, rod or other leverage device may be inserted into one of these holes 60 and be pulled upward in order to facilitate the removal of the spacer 50.

This embodiment of the spacer 50 may also have 3 flanges 54, as shown in FIG. 10. The inner arm 53 may be longer than shown in FIGS. 8 and 9, and, because additional support is provided, the shelf 16 of the drainage form 10 may not be necessary. In this case, the water will simply flow through the channel defined by the space between the floating slab 40, the wall 30, and the footing 32 to a low point in the slab, which is attached to a sump pump or the like. At the same time, the impermeable radon gas barrier 38 prevents the radon gas from entering the building through the floating slab 40.

Figure 12:
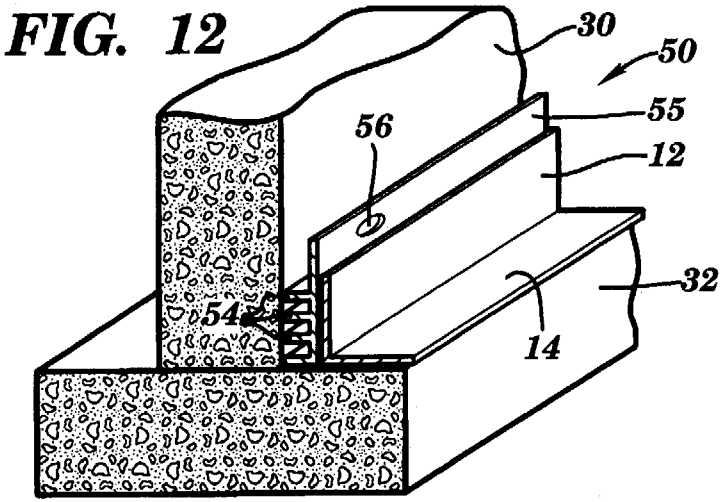
FIG. 12 is cross-sectional, perspective view of the L-shaped strip in combination with an alternative second embodiment of the spacer.

A second embodiment of the spacer 50 is shown in FIG. 11. This embodiment comprises a strip 55, having first and second sides, 55A and 55B respectively, extending above the top of the vertical portion 12 of the drainage form 10, and at least one flange, shelf, or finger 54 extending from the first side 55A. As shown in FIG. 12, the strip 55 may be provided with an aperture 56 for the insertion of a leveraging device in order to facilitate the removal of the spacer 50 after the floor slab 40 has set.

Figure 13:
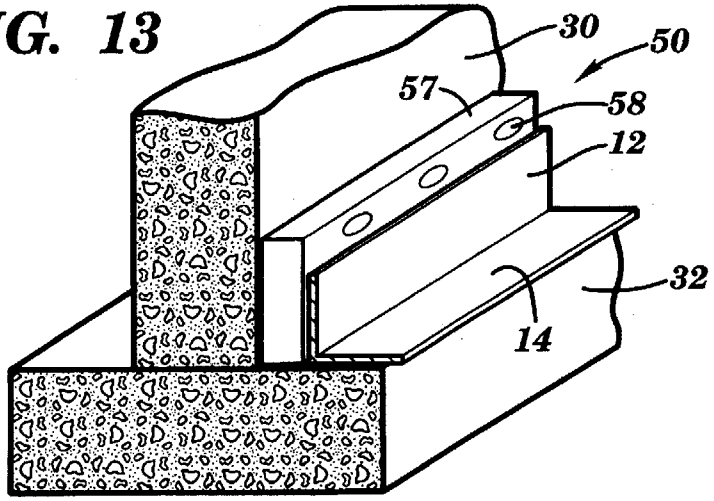
FIG. 13 is a cross-sectional, perspective view of the L-shaped strip in combination with a third embodiment of the spacer.

A third embodiment of the spacer 50 is shown in FIG. 13. This embodiment is a parallelepiped 57 made of a solid, such as wood or other material of the appropriate width. Optionally, the spacer 50 may be hollow and made of a material such as extruded plastic. The parallelepiped 57 may advantageously be provided with at least one hole or aperture 58, for the insertion of a leveraging device.

Figure 15:
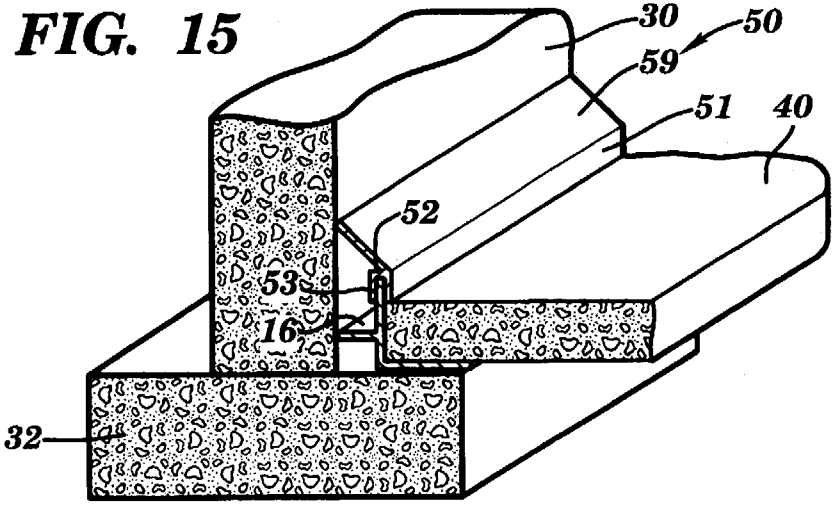
FIG. 15 is a cross-sectional, perspective view of the present invention in combination with a fourth embodiment of the spacer after the placement of the concrete.
Figure 14:
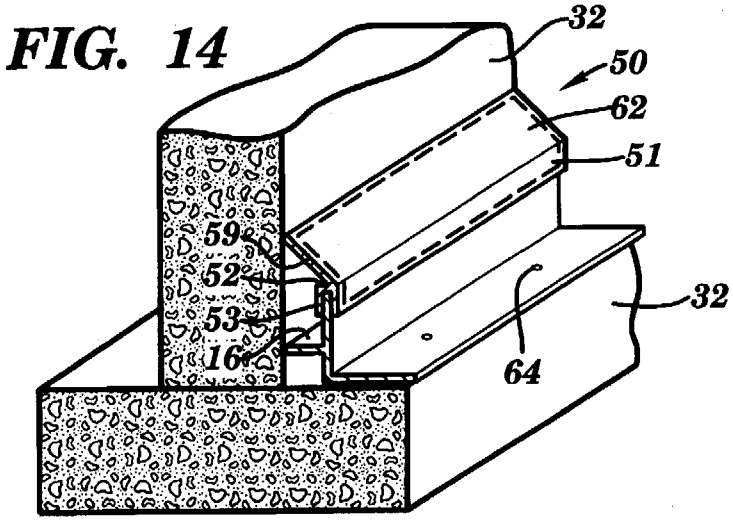
FIG. 14 is a cross-sectional, perspective view of the present invention in combination with a fourth embodiment of the spacer prior to the placement of the concrete.

A fourth embodiment of the spacer 50 being used in combination with the drainage form 10 is shown in FIGS. 14 and 15. This embodiment of the spacer 50 has an inner arm 53, an outer arm 51, and a base 52, like the first embodiment except that the inner arm 53 and the outer arm 51 are approximately the same length. This embodiment further comprises a secondary support member or flange 59 extending from the base 52. This flange 59 may be shaped so as to provide the look of a decorative molding and the flange 59 may also be covered with a removable tape 62, so that the spacer 50 may be put in place and attached to the footing 32 by fasteners 64 prior to pouring the concrete, as shown in FIG. 14, the concrete may be poured, and the tape removed, as shown in FIG. 15, and the flange 59 will be free of debris resulting from the placement of the concrete.

Those of ordinary skill will realize that many modifications may be made to the instant invention, the embodiments and options described herein, without departing from the scope or spirit of the following appended claims.

Accordingly, what is claimed is:

1. A device for forming a drain in a foundation including a drainage form having a vertical portion and a base, the drainage form being positioned at a distance from a joint between a wall, and a footing, the base of the drainage form being under a floor slab and on the footing, the vertical portion of the drainage form being a perimeter wall of the floor slab, said device comprising:

a removable spacer, having at least a portion adapted to be positioned between said drainage form and said wall for covering the distance between the drainage form and the wall daring the placement of the floor slab, thereby keeping the distance free from debris.

2. The device of claim 1, further comprising means for removing the spacer.

3. The device of claim 2, wherein the spacer is a parallelepiped, and wherein the means for removing the spacer comprises at least one pre-punched hole in an upper edge of the parallelepiped and, in combination, a lifting means for insertion into the hole.

4. The device of claim 2, wherein the spacer is a parallelepiped, and wherein the means for removing the spacer extends from the parallelepiped and is integrally connected thereto.

5. The device of claim 1, wherein the spacer comprises a base, an inner arm, an outer arm, wherein the inner arm is longer than the outer arm, and a flange extending from the inner arm and being integrally connected thereto.

6. The device of claim 5, further comprising a means for removing the spacer, wherein the means for removing the spacer comprises at least one pre-punched hole for the insertion of a lifting means.

7. The device of claim 1, wherein the spacer comprises: a strip, having first and second sides; and a finger extending from the first side.

8. The device of claim 7, wherein the strip comprises at least one pre-punched hole for the insertion of a lifting means.

9. The device of claim 7, further comprising means for removing the spacer, extending from the strip and integrally connected thereto.

10. The device of claim 1, wherein the spacer comprises: a base; an inner arm; an outer arm; and a flange, extending from the base and being integrally connected thereto.

11. The device of claim 10, further comprising a removable tape, adhered to the flange and the outer arm.

12. In combination:

a footing;

a wall, positioned on said footing;

a drainage form, spaced from said wall, having a first surface positioned on said footing and a second surface angularly offset from said first surface, thereby forming a channel defined by the wall, the footing and the second surface of the drainage form;

a floor slab having at least a portion formed adjacent said second surface; and a spacer, positioned between said second surface and said wall, so that the channel is covered by said spacer during the placement of the floor slab, adjacent and over the drainage form, thereby keeping the channel free from debris.

13. The combination of claim 12, wherein said spacer is removable.

14. The combination of claim 12, wherein said spacer is integrally attached to the second surface of the drainage form.

15. A method of forming a floor slab comprising the steps of:

providing a footing;

providing a wall, positioned on said footing;

providing a drainage form, having a first surface and a second surface angularly offset from said first surface;

positioning the first surface on said footing, the second surface being spaced from said wall, thereby forming a channel between the drainage form and the wall;

positioning a removable spacer between said wall and said drainage form, thereby covering the channel;

pouring a floor slab such that at least part of the floor slab formed adjacent and over the drainage form; and removing a removable portion of the spacer after the floor slab has set.

16. The method of claim 15, wherein removing the removable portion of the spacer comprises removing the entire spacer.

17. The method of claim 15, wherein removing the removable portion of the spacer comprises removing a tape from the spacer.

18. The method of claim 15, further comprising the step of:

fastening the first surface of the drainage form to the footing.

19. In a water removal system for floating slabs comprising, in combination: a footing; a wall, positioned on said footing; a drainage form, spaced from said wall, having a first surface positioned on said footing and a second surface angularly offset from said first surface, thereby forming a channel defined by the wall, the footing and the second surface of the drainage form; a floor slab having at least a portion formed adjacent said second surface;

a spacer, positioned between said second surface and said wall, so that the channel is covered by the spacer during the placement of the floor slab adjacent and over the drainage form, thereby keeping the channel free from debris.

* * * * *